United States Patent [19]

Toncelli

[11] Patent Number: 4,871,586

[45] Date of Patent: Oct. 3, 1989

[54] PROCESS FOR THE PREPARATION OF AN IRON ARMATURE FOR USE WITH SLABS OR REINFORCED ARTICLES FROM AN AGGLOMERATE OF SILICEOUS SAND, MARBLE, GRANITE OR, IN GENERAL, STONE

[76] Inventor: Marcello Toncelli, Via Giovanni XXIII, 2, Bassano del Grappa (Vicenza), Italy

[21] Appl. No.: 168,666

[22] Filed: Mar. 16, 1988

[30] Foreign Application Priority Data

Mar. 20, 1987 [IT] Italy ..... 85522 A/87

[51] Int. Cl.[4] ..... B05D 1/12

[52] U.S. Cl. ..... 427/204; 427/403; 427/410

[58] Field of Search ..... 427/204, 410, 403

[56] References Cited

U.S. PATENT DOCUMENTS

| | | | |
|---|---|---|---|
| 2,768,094 | 10/1956 | Gemmel et al. | 427/403 X |
| 3,030,664 | 4/1962 | Wijard | 427/403 X |
| 3,837,899 | 9/1974 | Carlberg | 427/403 X |
| 4,559,241 | 12/1985 | Obitsu et al. | 427/403 |
| 4,670,315 | 6/1987 | Hillemeier et al. | 427/403 X |

FOREIGN PATENT DOCUMENTS

| | | | |
|---|---|---|---|
| 2940213 | 10/1979 | Fed. Rep. of Germany | 427/403 |
| 61-238371 | 4/1985 | Japan | 427/403 |

*Primary Examiner*—Shrive Beck

*Attorney, Agent, or Firm*—Bucknam and Archer

[57] ABSTRACT

A process for the preparation of an iron armature for use with slabs or reinforced articles consists of making an agglomerate of siliceous sand, marble, granite or, in general, stone with cement as a binder, covering an iron armature rod (1) with the agglomerate to obtain a rod covered with a layer of the agglomerate, immersing said covered rod in a vessel (2) containing a resin (3) so that a film of resin on the covered rod is obtained, spreading on the surface thereof granules of siliceous sand or other stone material (4) so that adherence is achieved between the iron rod and the agglomerate, and resistance to oxidation and improvement in aesthetic properties is achieved. According to one embodiment of the invention, the resin may be sprinkled.

4 Claims, 1 Drawing Sheet

PROCESS FOR THE PREPARATION OF AN IRON ARMATURE FOR USE WITH SLABS OR REINFORCED ARTICLES FROM AN AGGLOMERATE OF SILICEOUS SAND, MARBLE, GRANITE OR, IN GENERAL, STONE

The present invention relates to slabs or articles manufactured from conglomerates of marble, granite or, in general, stones with cement as a binder, and more specifically relates to a process for the preliminary treatment of iron armatures to be used with the slabs or the manufactured articles for the purpose of improving the adherence between the two elements and simultaneously protecting the iron armature from phenomena of oxidation which would affect negatively the mechanical and aesthetic properties of the product.

According to the present state of the art, the iron armature being used within a manufactured article of reinforced concrete consists of steel rods which are disposed in a variety of ways according to the requirements of the particular constructions.

Rods may be made of homogeneous drawn steel of any section for the purpose of increasing the adherence, or may consist of twisted elements with projections or may be provided with cavities in order to improve the adherence. The latter, referred to as steel armature having improved adherence, may absorb tension in the range of one and one-half times the tension absorbed by rods with a smooth surface. However, the steel rods known in the art are subject to oxidation and corrosion which may cause also the total rupture of the rod and the consequent deterioration of the mechanical properties of the finished article.

The process of the present invention which will be discussed hereinbelow guarantees an improved adherence between the mixture and the armature and also permits to avoid the oxidation phenomena even in the presence of flaws of the manufactured article.

The invention is described by reference to the accompanying drawings which cover the successive stages of the process in which.

Figure 1:
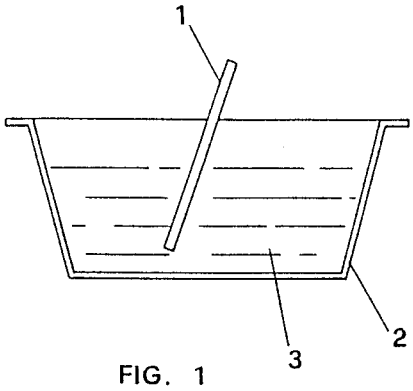
FIG. 1 illustrates schematically the immersion phase of the armature in the resin bath.

As shown in FIG. 1, the steel rod 1 to be subsequently used for the formation of the armature by casting so as to obtain slabs or any manufactured article from a conglomerate in general of marble, granite or stone with cement as a binder, is immersed in vessel 2 which contains an epoxy resin or another liquid resin 3.

Figure 2:
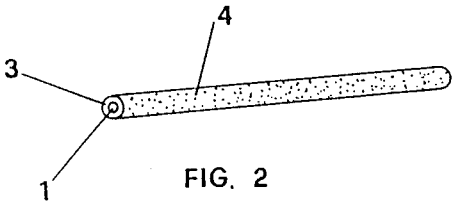
FIG. 2 is a perspective view of a portion of the armature covered with sand of different nature after the bath.

As shown in FIG. 2, the rod 1 is totally covered with a film of constant thickness of resin 3 which serves the function of providing a second film for the rod. The rod then is strewn wil siliceous sand or any other type of stone 4 so that the individual granules remain buried in the resin film 3. The rod 1 after this treatment is allowed to set at room temperature.

Figure 3:
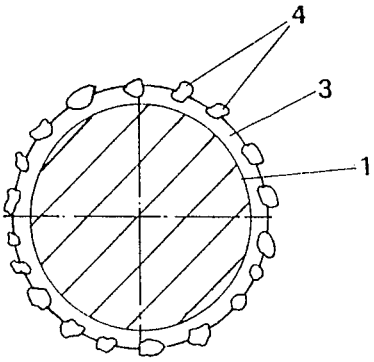
FIG. 3 is a cross-section of the armature after the process of the present invention has been carried out, ready for further application.

The resulting article consists of a steel armature 1 as shown in FIG. 3 covered by a regular film of resin 3 on which sand granules 4 are buried. The armature made by means of the rods treated and set in this manner is ready for use as the armature in slabs or manufactured articles of any shape from a conglomerate of siliceous sand, marble, granite or, in general, stone with cement as a binder. This armature exhibits an adherence at least superior with respect to known armatures because the adhesion between the resin and the steel rod is achieved and the adherence between the armature and the mix is not achieved between the mix and the armature, but between the granules of sand or other material 4 buried in the resin 3 and the mix. The adherence is guaranteed by the granules of sand 4 which form an integral body with the resin 3 and they, in addition, increase substantially the surface of adherence between the rod of the armature and the mix.

The rod of the armature thus covered is protected from oxidation which could cause cracking, a phenomenon which frequently occurs after the rods are allowed to set and under a load.

Indeed, even in the presence of cracks the rod of the armature 1 being covered by the film of resin 3 cannot be oxidized even if it is exposed to an oxidizing environment so that the mechanical properties of the slab or other manufactured articles from the conglomerate of marble, granite or other stone with cement as a binder remain unchanged.

In addition to the foregong, the rod according to the present invention does not exhibit spots on the surface, a phenomenon frequent in reinforced articles the armature of which has undergone oxidation.

According to another embodiment of the invention, the application of the resin film 3 on the rod of the armature 1 may be obtained by sprinkling instead of immersion. Obviously, the particular details of the process described hereinabove and illustrated in the drawings may be varied according to the requirements of each application without departing from the main features of the invention.

What is claimed is:

1. A process for the preparation of an iron armature for use with slabs or reinforced articles which consists of making an agglomerate of siliceous sand, marble, granite or, other, stone with cement as a binder, covering an iron armature rod (1) with said agglomerate to obtain a rod covered with a layer of said agglomerate, immersing said covered rod in a vessel (2) containing a resin (3) whereby a film of resin on said covered rod is obtained, spreading on the surface thereof granules of siliceous sand or other stone material (4) whereby adherence is achieved between said iron rod and said agglomerate, and resistance to oxidation is achieved.

2. A process for the preparation of an iron armature for use with slabs or reinforced articles which consists of making an agglomerate of siliceous sand, marble, granite or, other, stone with cement as a binder, covering an iron armature rod (1) with said agglomerate to obtain a rod covered with a layer of said agglomerate, sprinkling said covered rod with resin (3) whereby a film of resin on said covered rod is obtained, spreading on the surface thereof granules of siliceous sand or other stone material (4) whereby adherence is achieved between said iron rod and said agglomerate, and resistance to oxidation is achieved.

3. The process according to claim 1 wherein said resin (3) is an epoxy resin.

4. The process according to claim 2 wherein the said resin is an epoxy resin.

* * * * *